US006053322A

United States Patent [19]

Kim et al.

[11] Patent Number: 6,053,322

[45] Date of Patent: Apr. 25, 2000

[54] HANGING ORNAMENT KIT AND METHOD OF DECORATING A HANGING ORNAMENT

[75] Inventors: Paul S. Kim; Karyn L. Kim, both of Chester Springs, Pa.

[73] Assignee: Family Time Crafts, Inc., Exton, Pa.

[21] Appl. No.: 09/265,773

[22] Filed: Mar. 10, 1999

Related U.S. Application Data

[60] Provisional application No. 60/077,383, Mar. 10, 1998.

[51] Int. Cl.[7] ..... B65D 85/00

[52] U.S. Cl. ..... 206/575; 206/1.7; 427/290; 428/11

[58] Field of Search ..... 206/1.7, 223, 575; 434/84; 427/292, 407.2; 428/7, 11, 12, 34.6

[56] References Cited

U.S. PATENT DOCUMENTS

| | | | |
|---|---|---|---|
| 258,808 | 5/1882 | Rhind | 428/34.6 |
| 2,096,084 | 10/1937 | Birdseye | 428/34.6 |
| 3,440,128 | 4/1969 | Kubilius | 4287/11 |
| 3,849,911 | 11/1974 | Longenecker | 434/84 |
| 4,173,667 | 11/1979 | Rusch | 428/11 |
| 5,266,771 | 11/1993 | Van Wyk | 4287/11 |

*Primary Examiner*—Jim Foster

*Attorney, Agent, or Firm*—Akin, Gump, Strauss, Hauer & Feld, L.L.P.

[57] ABSTRACT

A hanging ornament kit including a generally transparent container comprising first and second components, each component having an interior surface and an opening at one side, and decorating material for decorating the interior surface of each component. The first component is detachably connected to the second component by a coupling on the periphery of at least one of the first and second component openings.

8 Claims, 2 Drawing Sheets

HANGING ORNAMENT KIT AND METHOD OF DECORATING A HANGING ORNAMENT

CROSS-REFERENCE TO RELATED APPLICATIONS

This application claims the benefit of U.S. provisional application No. 60/077,383 filed Mar. 10, 1998, entitled "HANGING ORNAMENT KIT AND ORNAMENT MADE WITH THE KIT".

BACKGROUND OF THE INVENTION

The present invention relates to Christmas and other ornaments and, more particularly, to a kit for decorating hanging ornaments and a method of decorating hanging ornaments.

Kits for decorating hanging ornaments are generally known. Such kits generally provide various preformed, paintable shapes of glass or plastic and include paints and brushes in the kit for applying the paint to the outside surface of the ornaments in a decorative manner. Also, there are hollow hanging ornaments, generally made of transparent glass in which paint may be poured into the ornaments and distributed on the inside surface of the ornament for decorative purposes. Glass ornaments are fragile and would be considered dangerous for young children to use. Also, the construction of glass ornaments being of one piece design limits the ways the user can decorate the interior of the ornament by limiting access to the ornament interior.

Accordingly, it would be desirable to have a hanging ornament kit which would be safe for a young child to use and which would allow greater access to the ornament interior so that the child could paint a design on the inside of the ornament, distribute paint in a fantastic style within the interior of the ornament and also place decorative objects within the inside of the ornament.

The present invention is directed to a hanging ornament kit comprising a generally transparent container and decorating material for decorating the interior surface of the container. The invention is further directed to a method of decorating the interior surface of a hanging ornament comprising separable parts.

SUMMARY OF THE INVENTION

Briefly stated the present invention comprises a hanging ornament kit including a generally transparent container comprising first and second components, each component having an interior surface and an opening at one side, and decorating material for decorating the interior surface of each component. The first component is detachably connected to the second component by a coupling on the periphery of at least one of the first and second component openings.

The present invention further comprises a method of decorating a hanging ornament comprising a hollow generally transparent container having first and second mirror image components, each component having an interior surface and an opening at one side, at least one of the first and second components having a detachable coupling on the periphery of the opening for connecting together the components. The method comprises the steps of separating the components if the components are initially connected, applying a decorating material to at least a portion of the interior surface of at least one component and connecting the components together to form a decorated container.

The present invention still further comprises a hanging ornament kit including a hollow generally transparent container having an interior surface, an access opening to the interior thereof and decorating material for decorating the interior surface of the container. The decorating material is for being introduced into the interior of the container through the access opening and for adhering to at least a portion of the interior surface of the container.

BRIEF DESCRIPTION OF THE SEVERAL VIEWS OF THE DRAWINGS

The foregoing summary as well as the detailed description of the presently preferred embodiments of the invention will be better understood when read in conjunction with the appended drawings. For the purpose of illustrating the invention, there are shown in the drawings embodiments which are presently preferred. It should be understood that the present invention is not limited to the particular arrangements and instrumentalities shown. In the drawings.

DETAILED DESCRIPTION OF THE INVENTION

Figure 1:
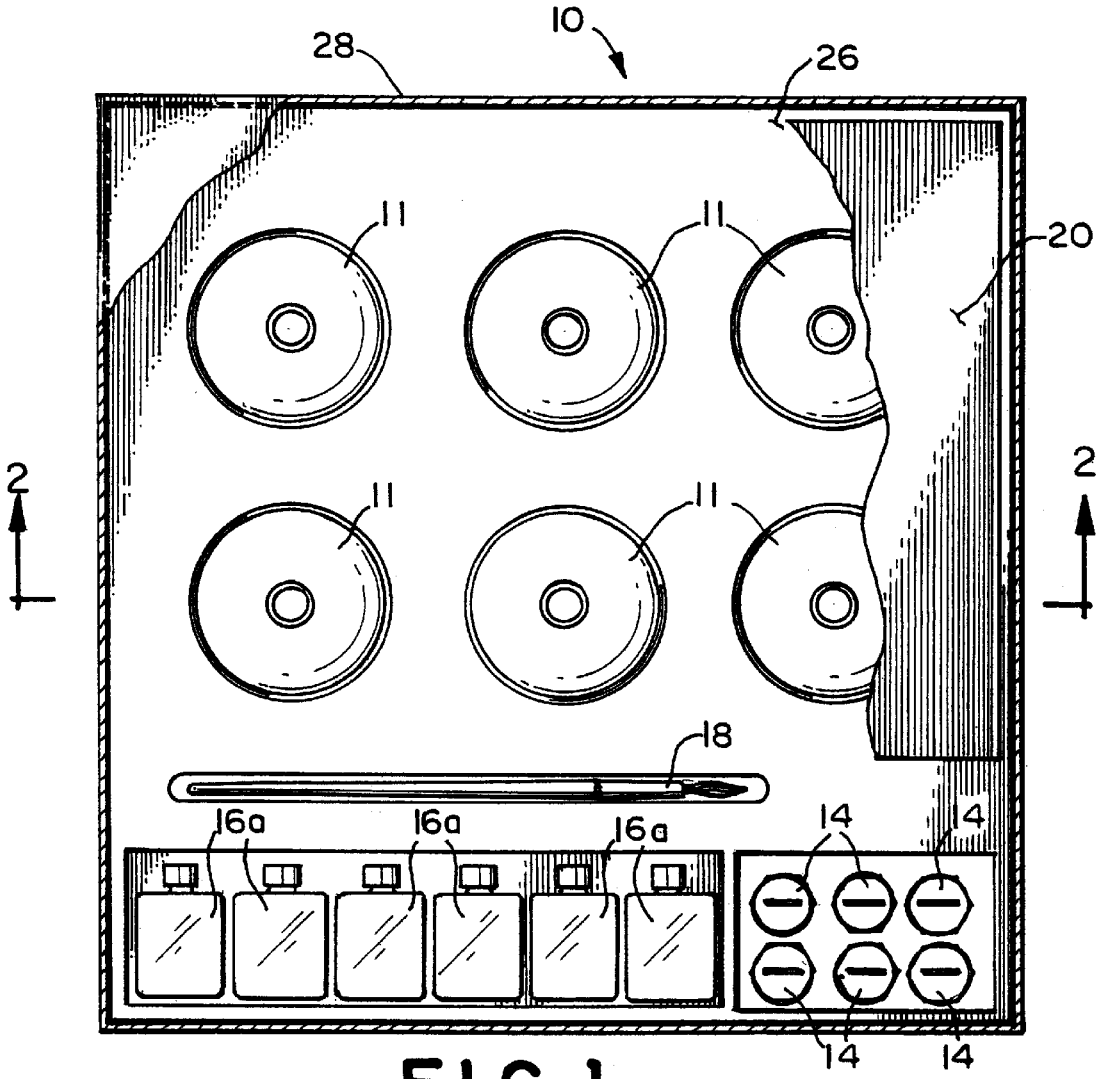
FIG. 1 is a top plan view, partially broken away of a hanging ornament kit in accordance with a first preferred embodiment of the present invention.

Certain terminology is used in the following description for convenience only and is not limiting. The words "right", "left", "lower" and "upper" designate directions in the drawings to which reference is made. The terminology includes the words above specifically mentioned, derivatives thereof and words of similar import.

Figure 2:
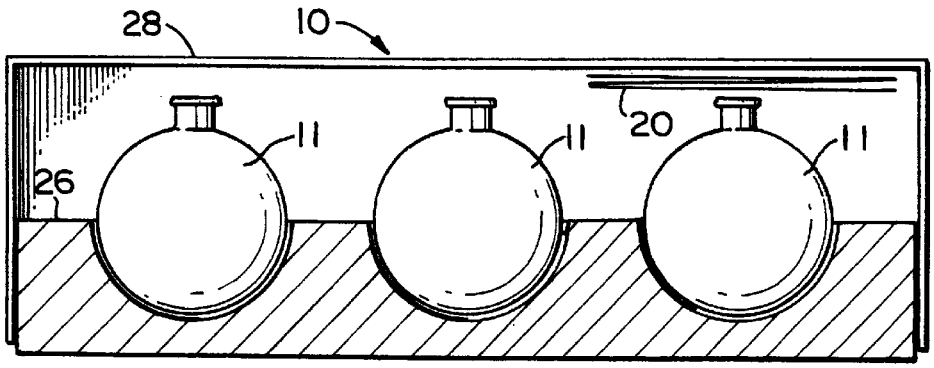
FIG. 2 is a sectional view of the kit taken along line 2—2 of FIG. 1.
Figure 3:
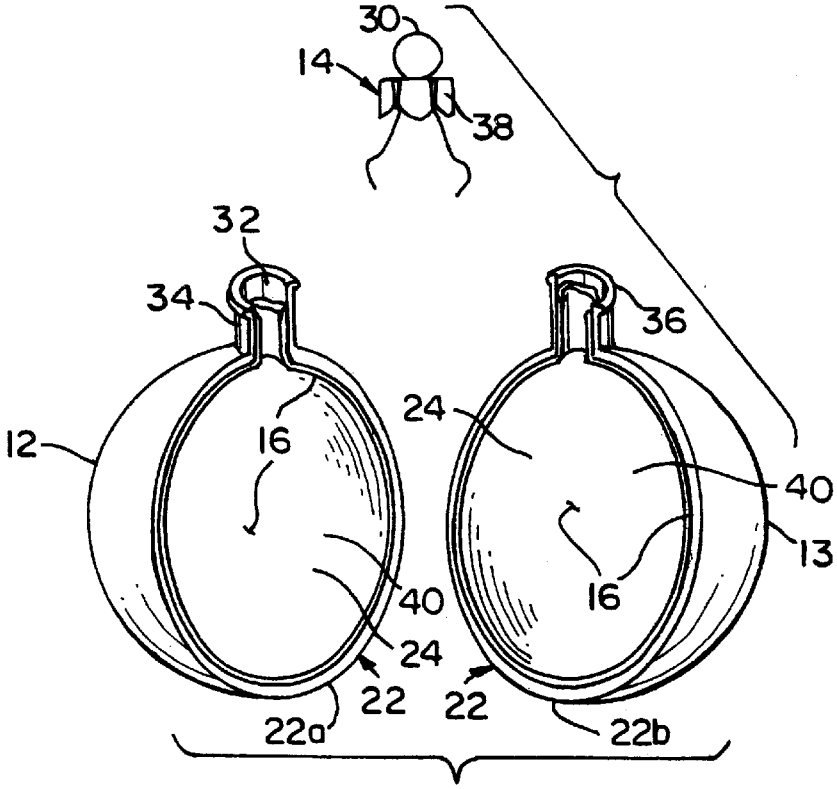
FIG. 3 is a an exploded perspective view of one of the ornaments of the kit of FIG. 1.

Referring to FIG. 1, 2 and 3, where like numerals indicate like elements throughout the several figures, there is shown a first preferred embodiment of a hanging ornament kit 10 comprising one or more generally transparent containers 11 (also referred to as hanging ornaments 11) including first and second mirror image components 12, 13, each component 12, 13 having an interior surface 40, and an opening 24 at one side, the first component 12 being detachably connected to the second component 13 by a coupling 22*a*, 22*b* on the periphery 22 of at least one of the first and second component openings 24, and decorating material such as paint 16 for the interior surface 40 of each component 12, 13. In the first preferred embodiment of the hanging ornament kit 10 there are six hanging ornaments 11, three of which are made of a transparent polymeric material and three of which are made of an iridescent polymeric material, six hanging devices 14, one for hanging each decorated hanging ornament 11 on a supporting structure such as a Christmas tree or the like (not shown), an implement such as a brush 18 for applying the decorating material 16 to the interior surface 40 of each component 12, 13, six containers of decorating material 16*a*, a pamphlet of instructions 20, a tray 26 and a receptacle 28 for securely holding the hanging ornaments 11, the containers of decorating material 16*a* and other items previously mentioned. However, it is understood by those skilled in the art that the composition of the kit 10 may vary. One skilled in the art would understand that the quantity of hanging ornaments 11, decorating material containers 16*a*, implements 18 and hanging devices 14, could be any number, but at least one each, with the number of hanging devices 14 desirably corresponding to the number of containers 1 1. Also, the number of hanging ornaments 11 that are transparent or iridescent could vary from all of iridescent to all transparent without departing from the spirit and scope of the invention.

In the preferred embodiment of the hanging ornament kit 10, shown in FIGS. 1 and 2, the hanging ornaments 11, hanging devices 14, paint bottles 16*a*, pamphlet of instructions 20 and paint brush 18 are contained in a polystyrene or paperboard tray 26 which has separate wells to hold the different Kit articles. However, It is understood by those skilled in the art from this disclosure that tray 26 may be of a different configuration from that shown in FIGS. 1 and 2 and be constructed of any material which provides for secure packaging of the articles of the hanging ornament kit 10. For instance, the tray 26 may be of celluloid or cardboard without departing from the spirit and scope of the invention.

In the first preferred embodiment of the hanging ornament kit 10, and referring now to FIG. 3, the hanging ornaments 11 are hollow spheres preferably made of an acrylic material. In the first preferred embodiment of the hanging ornament 11, the first and second components 12, 13 are respectively a first hemisphere 12 and a second hemisphere 13. The hemispheres 12, 13 attach to each other with a snap connection 22*a*, 22*b* molded into and extending around the entire opening 24 of each hemisphere 12, 13. The snap connection 22*a*, 22*b* comprising a male connection 22*a* on the first hemisphere 12 and a female connection 22*b* on the second hemisphere 13. The hemispheres 12, 13 are mirror images of each other except for the male/female construction of the snap connections 22*a*, 22*b*. The snap connection 22*a*, 22*b* is of such a nature that allows the hanging ornament 11 to be assembled and disassembled by a child or other user without the need for tools. As will be appreciated by one skilled in the art, the connection between the first and second components 12, 13 need not be a snap connection. The connection 22*a*, 22*b* may be, for instance, a screw connection or a friction connection and still be within the spirit and scope of the invention.

In the preferred embodiment of the hanging ornament 11, shown in FIG. 3, the outside diameter of each hanging ornament 11 is approximately 2½ inches. The hanging ornament 11 has an appendage 34 surrounded by a lip 36 on which a hanging device 14, preferably made of a lightweight metal, may be attached for the purpose of hanging the hanging ornament 11 on a tree or other support. The appendage 34 has an opening 32 for securing the hanging device 14, in a manner well known in the art and for the pouring of decorating material 16 through. The inside diameter of the opening 32 for the hanging device 14 is approximately 3 ⅛ inch. As will be appreciated by one skilled in the art, the first preferred embodiment of the hanging ornament 11 may be constructed without an appendage 34 and/or without an opening 32 or may merely provide an opening 32 formed from apertures in the first and second hemispheres 12, 13 which are aligned when the first and second hemispheres 12, 13 are attached, and still be within the spirit and scope of the invention.

It will be understood by those skilled in the art from this disclosure that the hanging ornament 11 is not limited to any particular size or shape. The shape of the hanging ornament 11 could be, for instance, any three dimensional geometrical or fanciful shape that could be assembled from two mirror image halves or two halves which are not precise mirror images of each other. For instance, the hanging ornament 11 could be cubic, heart shaped or egg shaped and could have rounded or flat sides without departing from the spirit and scope of the invention. Similarly, the size of the hanging ornament 11 is not limited to any particular size. Furthermore, while the preferred embodiment is a transparent acrylic which may be optionally iridescent, it is understood by those skilled in the art from this disclosure that the present invention is not limited to any particular material or color or transparency of the material. The hanging ornament 11, for instance, could be any polymeric material of any color and it could, for instance, have opaque reflecting material embedded therein without departing from the spirit and the scope of the invention.

In the preferred embodiment of the hanging ornament kit 10 the hanging device 14 is a metal cap. The metal cap 14, shown in FIG. 3 is gold colored and comprises a top 38 and a spring 30. The top 38 has leaf-like sides which grip the lip 36 of the appendage 34 when the top 38 is snapped onto the appendage 34. A metal spring 30 when inserted through an opening in the top 38, expands into the appendage opening 32 to secure the top 38 onto the hanging ornament 11. The metal spring 30 is fashioned with a loop for the purpose of attaching the hanging ornament 11 to a Christmas tree or other supporting structure using a standard hook, ribbon, string or the like. It is understood by those skilled in the art from this disclosure that the cap 14 need not be metal but could be made of polymeric material, and need not be gold colored but could be of any color without departing from the spirit and scope of the invention. Further, the cap 14 need not have leaflike sides but could be, for instance, merely a disk with a diameter greater than the hole 32 and providing for the spring 30 to hold the cap 14 to the hanging ornament 11. Additionally, the hanging device 14, need not be a separate member but could be an integral part of the hanging ornament 11. For instance, a hook-like appendage could be molded on each component 12, 13 for attaching the hanging ornament 11 to a structure and still be within the spirit and scope of the invention.

Also, in the first preferred embodiment of the hanging ornament kit 10, the implement 18 for applying the decorating material 16 is a paintbrush and the six decorating material containers 16*a* are bottles of paint 16. In the first preferred embodiment the bottles of paint 16*a* contain non-toxic acrylic paint 16 of different colors to be applied to the hanging ornaments 11 as described in succeeding paragraphs. It is understood by those skilled in the art from this disclosure that the paint 16 may be of any composition or color compatible with the material of the hanging ornaments 11. For instance, the paint 16 could include reflective particles without departing from the spirit and scope of the invention. Further, the decorating material 16 is not limited to paint. It will be apparent to those skilled in the art that the decorating material 16 could be any type of liquid or semi-liquid medium incorporating a pigment or could, in fact, be any decorative objects capable of adhering or being attached to the interior surface 40 of the hanging ornament 11 and still be within the spirit and scope of the invention.

The first preferred embodiment of the hanging ornament kit 10 further includes a method of decorating a hollow generally transparent container 11 having first and second, preferably mirror image components 12, 13 each component 12, 13 having an interior surface 40 and an opening at one side 24, at least one of the first and second components 12, 13 having a detachable coupling 22*a*, 22*b* on the periphery 22 of the opening 24 for connecting together the components 12, 13. The method comprises the steps of separating the components 12, 13 if the components 12, 13 are initially connected, applying a decorating material 16 to at least a portion of the interior surface 40 of at least one component 12, 13 and connecting the components 12, 13 together to form a decorated container 11.

Figure 4:
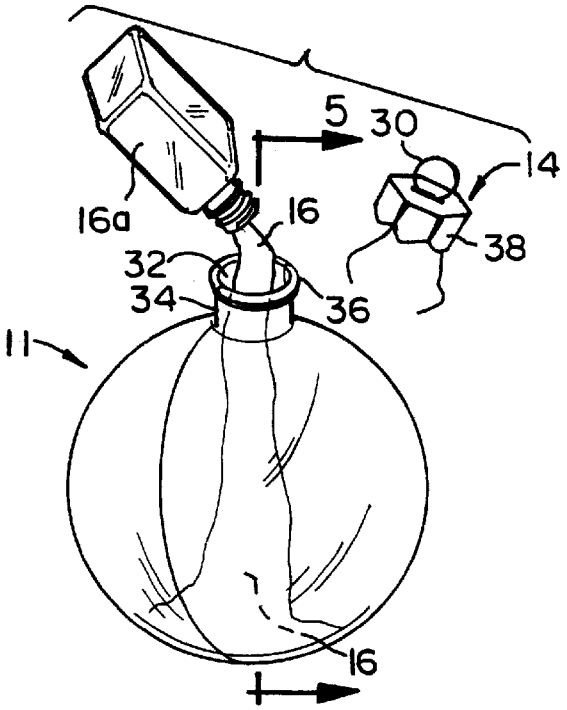
FIG. 4 is a perspective view of a hanging ornament and a hanger in accordance with a second preferred embodiment of the invention showing decorating material being poured from a decorating material container into the interior of the hanging ornament.
Figure 5:
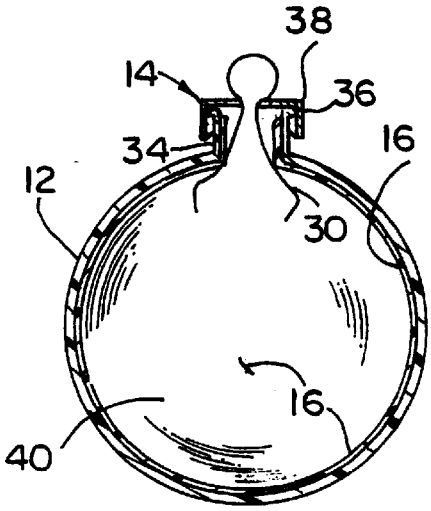
FIG. 5 is a sectional view of the hanging ornament taken along the line 5—5 of FIG. 4.

There is further shown in FIGS. 1, 2, 4 and 5 a second preferred embodiment of the hanging ornament kit 10 comprising hollow generally transparent containers 11 each having an interior surface 40 and an access opening 32 to the interior thereof, and decorating material 16 for decorating the interior surface 40 of the containers 11, the decorating material 16 for being introduced into the interior of the containers 11 through the access opening 32 and for adhering to at least a portion of the interior surface 40 of the containers 11. In the second preferred embodiment of the hanging ornament kit 10, the hanging ornaments 11 are of one-piece construction, having an access opening 32 through which the decorating material 16 may be introduced by pouring or other means as shown in FIG. 4. As in the first preferred embodiment the hanging ornaments 11 may be made of various transparent materials and in various shapes within the spirit and scope of the invention. The second preferred embodiment of the hanging ornament kit further includes a pamphlet of instructions 20 for decorating the containers 11, a hanging device 14 for hanging each of the decorated containers 11 on a supporting structure, a tray 26 and a receptacle 28 for securely holding at least the containers 11 and the decorating material 16.

The second preferred embodiment of the hanging ornament kit 10 further includes a method of decorating a hollow generally transparent container 11 having an interior surface 40 and an access opening 32 to the interior thereof. The method comprises the steps of introducing a decorating material 16 into the interior of the container through the access opening 32 and manipulating the container 11 to cause the decorating material 16 to move around and to adhere to at least a portion of the interior surface 40 of the container 11 in a decorative pattern.

In use, the preferred embodiment of the hanging ornament kit 10 provides a creative and safe means for making hanging ornaments 11 and provides enhanced opportunities for creative scope over the usual ornament kits by allowing access to the interior of the hanging ornament 11. Each hanging ornament 11 may be decorated by pouring a few drops of paint 16 through the appendage opening 32 and shaking or swirling the paint 16 to obtain a desired effect. Many different decorating materials 16 and combination of decorating materials 16 may be poured through the access opening 32 either in rapid succession, so that the decorating materials 16 mix while they are still fluid or following the drying of the preceding decorating material 16 application. Also, the hanging ornament 11 exterior may be painted. In addition, and unlike existing ornaments, the ornament hemispheres 12, 13 may be separated. The ability to separate the ornament hemispheres 12, 13 allows the interior surfaces 40 to be decorated with the brush 18 or another implement and allows the decorating materials 16 to be removed from the interior surface 40 if the design is to be changed. Objects such as photographs or geometrical shapes may be enclosed in the hanging ornament 11 for added visual effects and objects such as bells may be enclosed for their aural effects. Sticky labels of different configurations, attached by adhesives, electrostatically or otherwise, may be applied to decorate the hanging ornament 11.

From the foregoing description it can be seen that the present invention comprises a kit for making ornaments for which both children and adults will find utility. It will be appreciated by those skilled in the art that changes and modifications may be made to the above described embodiment without departing from the spirit and scope of the inventive concept thereof. It is understood therefore that the present invention is not limited to the particular embodiment disclosed but is intended to include all modifications and changes well within the scope and spirit of the invention.

I claim:

1. A hanging ornament kit comprising:

a generally transparent container comprising first and second components, each component having an interior surface and an opening at one side, the first component being detachably connected to the second component by a coupling on the periphery of at least one of the first and second component openings;

liquid decorating material, including a pigment, for decorating the interior surface of each component; and a receptacle securely holding at least the container and the decorating material.

2. The hanging ornament kit of claim 1 further including an implement for applying the decorating material to the interior surface of each component.

3. The hanging ornament kit of claim 1 further including a pamphlet of instructions for decorating and assembling the container.

4. The hanging ornament kit of claim 1 further including a hanging device for hanging the decorated container on a supporting structure.

5. A method of decorating a hanging ornament comprising a hollow generally transparent container having first and second components, each component having an interior surface and an opening at one side, at least one of the first and second components having a detachable coupling on the periphery of the opening for connecting together the components, the method comprising the steps of:

separating the components if the components are initially connected;

applying a decorating material to at least a portion of the interior surface of at least one component; and connecting the components together to form a decorated container, wherein the decorating material is a liquid medium including a pigment.

6. A hanging ornament kit comprising:

a hollow generally transparent container having an interior surface and an access opening to the interior thereof;

decorating material for decorating the interior surface of the container, the decorating material for being introduced into the interior of the container through the access opening and for adhering to at least a portion of the interior surface of the containers;

a receptacle; and a tray holding the transparent container and the decorating material within the receptacle.

7. The hanging ornament kit of claim 6 further including a pamphlet of instructions for decorating the container.

8. The hanging ornament kit of claim 6 further including a hanging device for hanging the decorated container on a supporting structure.

* * * * *